US005986541A

United States Patent [19]

Hibiya

[11] Patent Number: 5,986,541

[45] Date of Patent: Nov. 16, 1999

[54] MOTOR DRIVEN BELL

[75] Inventor: Yutaka Hibiya, Kanagawa, Japan

[73] Assignee: Fujikura Denko Kabushiki Kaisha, Tokyo, Japan

[21] Appl. No.: 09/023,181

[22] Filed: Feb. 13, 1998

[30] Foreign Application Priority Data

Sep. 2, 1997 [JP] Japan ..... 9-237226

[51] Int. Cl.[6] ..... G08B 3/00

[52] U.S. Cl. ..... 340/392.1; 340/392.2; 340/392.4; 340/692; 116/152; 116/148

[58] Field of Search ..... 340/392.1, 392.4, 340/393.2, 395.1, 392.5, 396.1, 328, 692, 384.1, 384.4, 384.7, 390.1, 390.2, 392.2; 116/152, 154, 155, 158, 172, 156, 159, 148, 163, 157

[56] References Cited

U.S. PATENT DOCUMENTS 2,269,098 1/1942 Garnett ..... 340/392.1
4,380,758 4/1983 Ishii ..... 340/392.2
5,150,097 9/1992 Sakaguchi ..... 340/396
5,587,697 12/1996 Rent ..... 340/392.4

*Primary Examiner*—Jeffery A. Hofsass
*Assistant Examiner*—Anh La
*Attorney, Agent, or Firm*—Price, Heneveld, Cooper, DeWitt & Litton

[57] ABSTRACT

A motor driven bell for producing a sound of a bell in a manner that a hammer member hits a gong through the use of a driving force of a motor. The motor driven bell comprises a supporting shaft A1 born on a front side between a pair of opposed frames, a forward and backward swingable shaft A2 suspended by a suspending arm A3 under the supporting arm A1, a supporting shaft B1 born at a rear portion between the pair of frames, and a forward and backward swingable shaft B2 suspended by a suspending arm B3 under the supporting shaft B1, a forward and backward swingable hammer member held by the swingable shafts A2, B2, and a gong to be hit with the hammer member. A crank mechanism is provided for converting rotation of a shaft of the drive motor into a swinging motion of the swingable shaft B2, thereby hitting the gong by the hammer member to produce the bell sound.

4 Claims, 5 Drawing Sheets

MOTOR DRIVEN BELL

BACKGROUND OF THE INVENTION

1. Field of the Invention

The present invention relates to a motor driven bell for producing a sound of a bell (sounding a bell) in a manner that a hammer member hits a gong through the use of driving force of a motor.

2. Description of the Related Art

FIGS. 7 and 8 are cross-sectional views showing a motor driven bell disclosed in the Japanese Utility Model Publication No. H3-69199.

In the illustrations, numeral 31 represents a gong, and numeral 32 designates a hammer member fixed at right angles to a portion adjacent to a tip portion 33*a* of a plate spring 33. Further, numeral 34 denotes a support for fixing the proximal portion of the plate spring 33, with the plate spring 33 being held at right angles with respect to a drive shaft 36 of a motor 35. The tip portion 33*a* of the plate spring 33 is inclined with respect to the drive shaft 36 of the motor 35 to further separate from a circumferential wall 31*a* of the gong 31 as it becomes closer to its tip, and a cam member 37 is formed to have a disc-like configuration and is supported by the motor shaft 36 in a state of being in an eccentric condition. Besides, the aforesaid tip portion 33*a* is located to face the interior of the locus of a circumferential portion 37*a* of a large-diameter section of the cam member 37. With this arrangement, when the motor 35 is driven in the FIG. 7 state to rotate the cam member 37, the circumferential portion 37*a* of its large-diameter section gradually approaches the tip portion 33*a* of the plate spring 33 so that as shown in FIG. 8 the circumferential portion 37*a* of the large-diameter section finally comes into contact with the tip portion 33*a* of the plate spring 33 to push the tip portion 33*a* of the plate spring 33 toward its proximal portion 33*b*. At this time, since the tip portion 33*a* is in the inclined condition with respect to the drive shaft 36, the force of pushing toward the proximal portion 33*b* is converted into a force to be applied in a direction of separating from a circumferential wall 31*a* of the gong 31, so that the plate spring 33 is deflected in a direction of separating from the gong 31 in a state where the aforesaid proximal portion 33*b* works as a supporting point and the hammer member 32 separates from the circumferential wall 31*a* of the gong 31, while a returning force F occurs in the plate spring 33. Thereafter, as the cam member 37 further rotates to cause the cam member 37 to disconnect from the tip portion 33*a* of the plate spring 33 as shown in FIG. 7, the plate spring 33 returns to the snap condition due to its own returning force F so that the hammer member 32 hits the gong 31 to ring a bell.

With the arrangement mentioned above, in the prior motor driven bell, the abrasion of the cam member and the plate spring is little because the cam member intermittently comes into contact with the plate spring, but on the other hand there are problems such that the power consumption increases because the cam member necessarily once comes into contact with the plate spring per one revolution of the drive shaft and slides against the repulsion of the plate spring, and further that the natural frequency of the plate spring differs from the frequency of the plate spring occurring when being forcibly moved by the cam member, causing the plate spring and the cam member to act against each other to offset the hitting force of the hammer member to the gong.

SUMMARY OF THE INVENTION

The present invention has been developed with a view to eliminating the foregoing problems, and it is an object of this invention to provide a motor driven bell which is capable of continuously producing an excellent hammering sound with minimized power consumption.

For this purpose, in accordance with the present invention, a motor driven bell is composed of a supporting shaft A1 born on a front side between a pair of frames disposed in an opposed relation to each other, a swingable shaft A2 suspended by a suspending arm A3 under the supporting shaft A1 to be swingable in the forward and backward directions, a supporting shaft B1 born at a rear portion between the pair of frames, a swingable shaft B2 suspended by a suspending arm B3 under the supporting shaft B1 to be swingable in the forward and backward directions, a hammer member held by the swingable shafts A2, B2 to be swingable in the forward and backward directions, a gong to be hit with the hammer member, a drive motor, and a crank mechanism for converting the rotation of a shaft of the drive motor into a swinging motion of the swingable shaft B2.

Moreover, in the motor driven bell, the supporting shafts A1, B1, the swingable shafts A2, B2 and the suspending arms A3, B3 are constructed using a metallic wire rod processed by bending and having a circular cross section. Further, the suspending arm B3 comprises an upper extending portion B31 extending backwardly with respect to the supporting shaft B1, a lower extending portion B32 extending backwardly with respect to the swingable shaft B2, and an intermediate bent loop portion B3L for making a connection between the upper and lower extending portions B31, B32. This bent loop portion B3L is loosely engaged with a crank pin P fixedly secured to the drive shaft of the drive motor so that a vertical movement of the crank pin P is converted into a swinging movement of the bent loop portion B3L made in a state where the supporting shaft B1 of the bent loop portion B3L works as a supporting point.

BRIEF DESCRIPTION OF THE DRAWINGS

The object and features of the present invention will become more readily apparent from the following detailed description of the preferred embodiments taken in conjunction with the accompanying drawings in which.

DETAILED DESCRIPTION OF THE INVENTION

Figure 1:
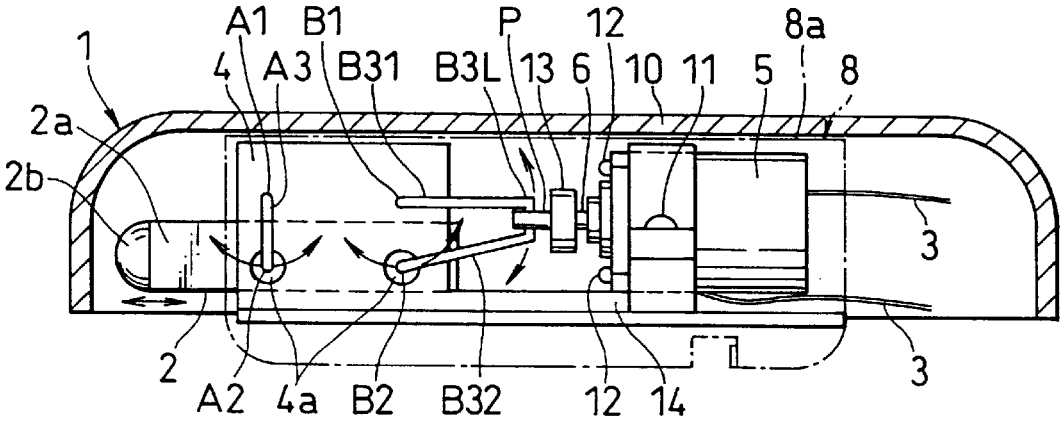
FIG. 1 is a side elevational cross-sectional view showing a motor driven bell according to an embodiment of the present invention.

FIGS. 1 to 6(*d*) are illustrations of a motor driven bell according to an embodiment of the present invention. FIGS.

1, 2 and 3 are a side elevational view, a rear elevational view and a perspective view of a principal portion, respectively. In the illustrations, numeral 1 stands for a gong having a circular dish-like configuration. Numeral 8 depicts a cover made by press formation of a metallic plate to have a rectangularly bent configuration, set through a tapping screw (not shown) near a central part of the gong 1 in a state where its central portion 8*a* is used as a top board. In one lower end of this cover 8, two brackets 8*b* are made by punching, while in the other end thereof, three insertion holes 8*c* are made by punching. Further, numeral 9 denotes a rectangular plastic-made base plate, where two elongated holes 9*a* for screws are made in one long side while three insertion projecting pieces 9*b* are formed on the other long side. Thus, the rectangular plastic-made base plate 9 is set to the cover 8 by inserting the three insertion projecting pieces 9*b* into the three insertion holes 8*c,* putting the two elongated holes 9*a* for screws to the two brackets 8*b* and then screw fastening.

Numerals 4, 4 signify a pair of frames disposed in an opposed relation to each other, and formed by the injection molding together with the base plate 9 or attached to the base plate 9 by means of bonding processing. Reference character A1 represents a supporting shaft born at a front upper portion between the pair of frames 4, 4, and reference character A3 designates a suspending arm made by downwardly bending an extension of the supporting shaft A1 at right angles. Further, reference character A2 denotes a swingable shaft made by inwardly bending an extension of the suspending arm A3 and located right below the supporting shaft A1. Since the pair of frames 4,4 have holes 4*a* formed into a circular shape, the swingable shaft A2 suspended from the supporting shaft A1 by the suspending arm A3 is swingable in the forward and backward directions by an external force without interference with the frames 4,4. Further, reference character B1 denotes a supporting shaft born at a rear upper portion between the pair of frames 4, 4, and positioned to be equal in level to the aforesaid supporting shaft A1. Reference character B3 depicts a suspending arm made by bending an extension of the supporting shaft B1. This suspending arm B3 is complicatedly bending-processed, and subsequently its extension is bent to form the swingable shaft B2 right under the supporting shaft B1. This swingable shaft B2 is located to be equal in level to the aforesaid swingable shaft A2 and made to be swingable by an external force in the forward and backward directions.

Since the circular holes 4*a* are made in the vicinity of a portion of the frames 4, 4 through which the swingable shaft B2 passes, the swingable shaft B2 is also swingable in the forward and backward directions by an external force without interference with the frames 4,4. However, it is also appropriate that the dimension of the circular holes 4*a* is set to be in immediate proximity to the amplitude of the swingable shaft B2 such that the swingable shaft B2 is brought into contact with the circular holes immediately before the crank pin P rises to reach the upper limit. In this case, the swinging energy of the hammer member 2 retreating is absorbed and a reactive force occurs to assist the downward movement of the crank pin P, which allows more reduction of the power consumption.

Figure 3:
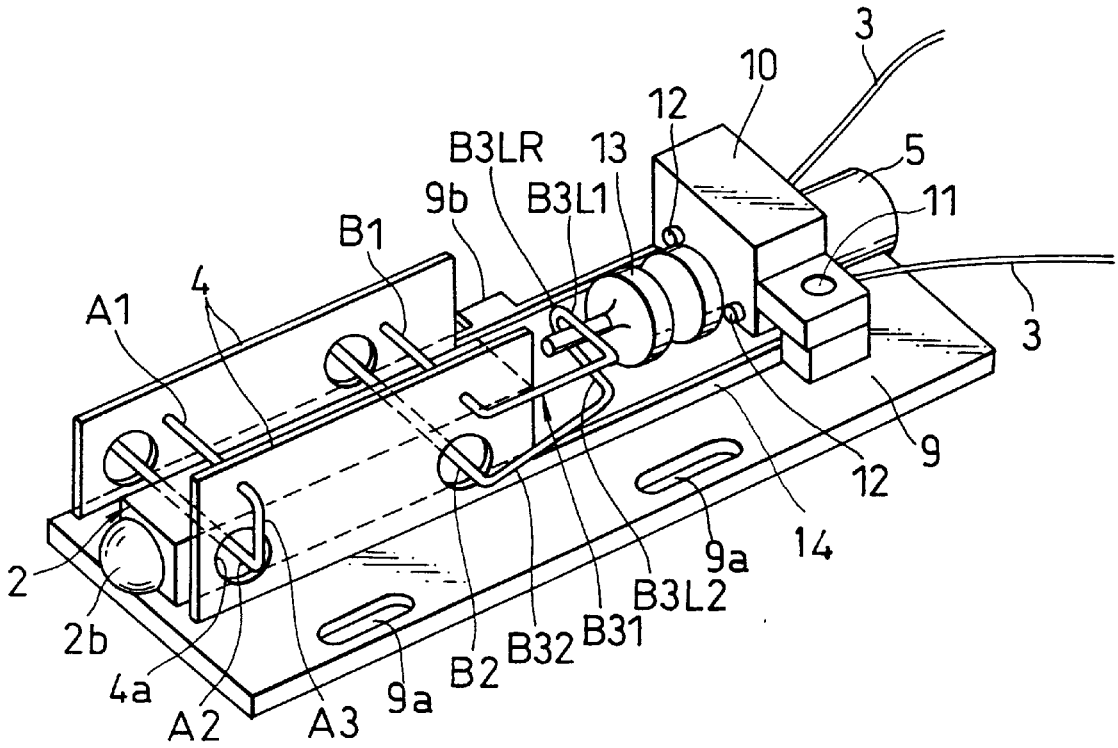
FIG. 3 is a perspective view showing the motor driven bell according to an embodiment of this invention.

The aforesaid suspending arm B3 is made up of an upper extending portion B31 extending backwardly from the supporting shaft B1, a lower extending portion B32 extending backwardly from the swingable shaft B2, and an intermediate bent loop portion B3L. As shown in FIG. 3, this bent loop portion B3L is bending-processed to be substantially in parallel to the supporting shafts A1 and B1, and is composed of an upper parallel portion B3L1 and a lower parallel portion B3L2 which are disposed to be in parallel with each other in a state where a given separation is defined therebetween, and further of an arc-like connecting portion B3LR.

Figure 5:
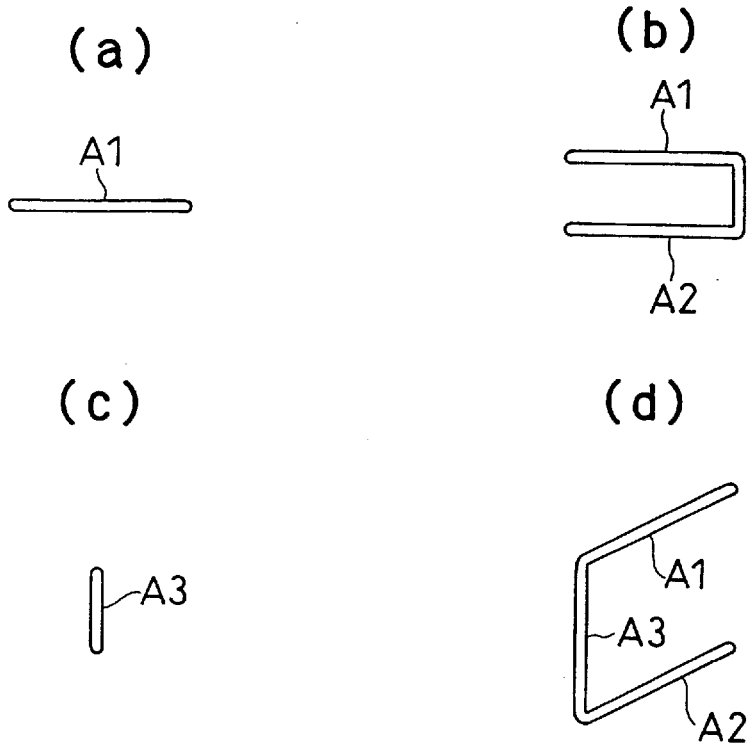
FIGS. 5(*a*) to 5(*d*) are a plan view, a front elevational view, a side elevational view and a perspective view each showing a spring A of the motor driven bell according to an embodiment of this invention.
Figure 6:
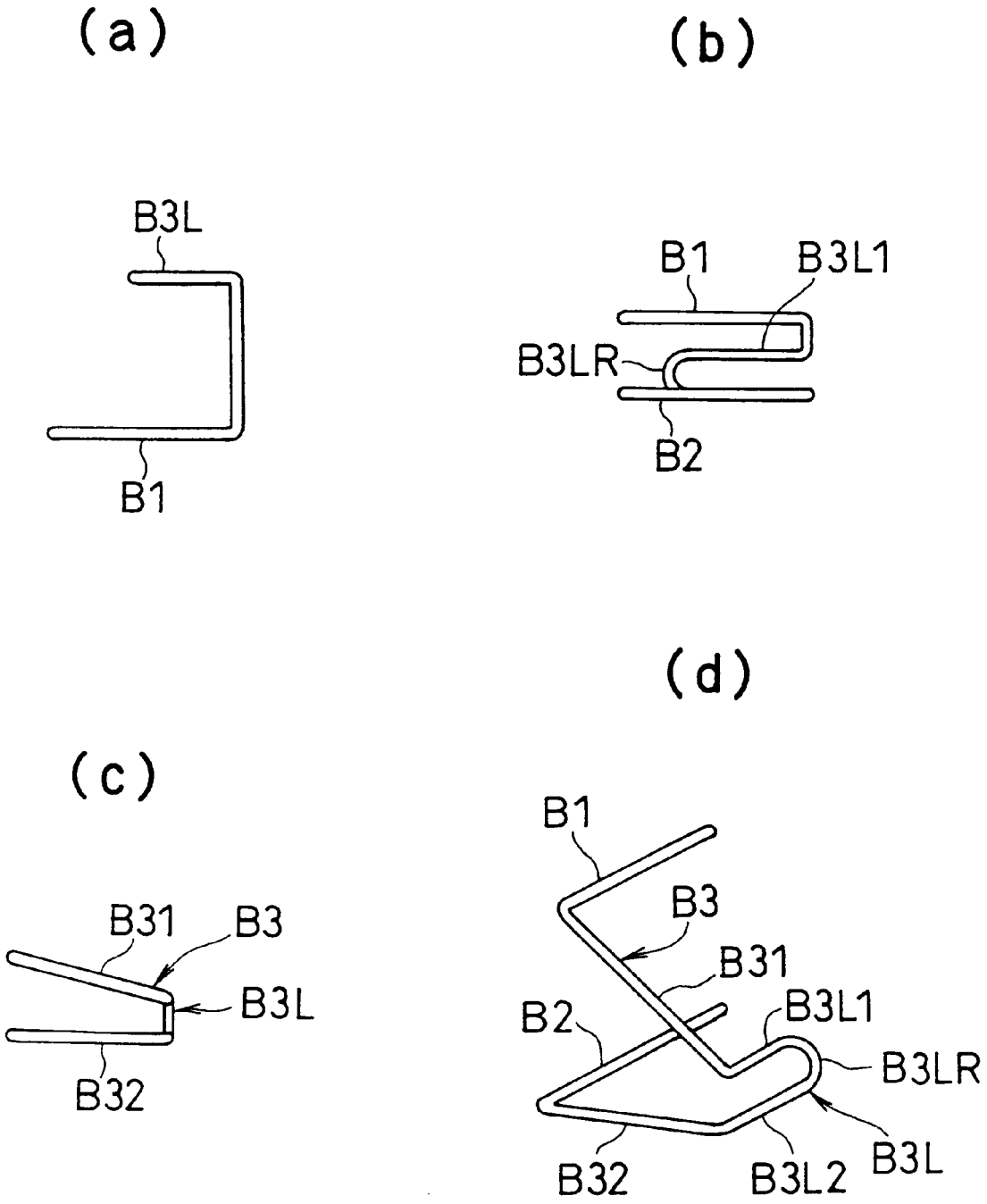
FIG. 6(*a*) to 6(*d*) are a plan view, a front elevational view, a side elevational view and a perspective view each showing a spring B of the motor driven bell according to an embodiment of this invention.
Figure 7:
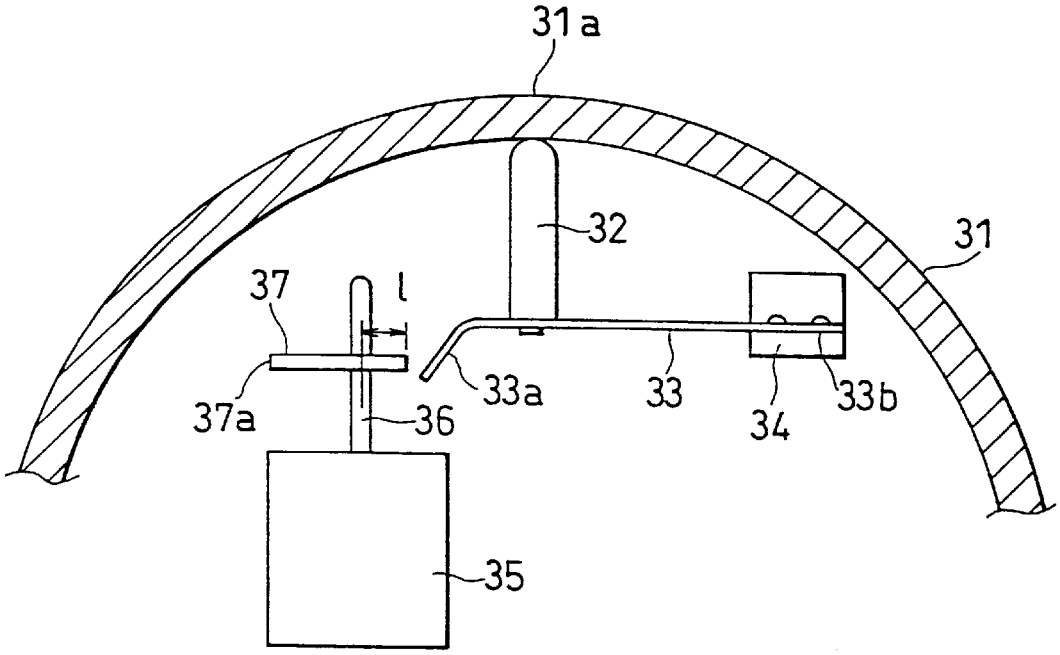
FIG. 7 PRIOR ART
FIGS. 7 and 8 are cross-sectional views each showing an operating state of a prior motor driven bell.
Figure 8:
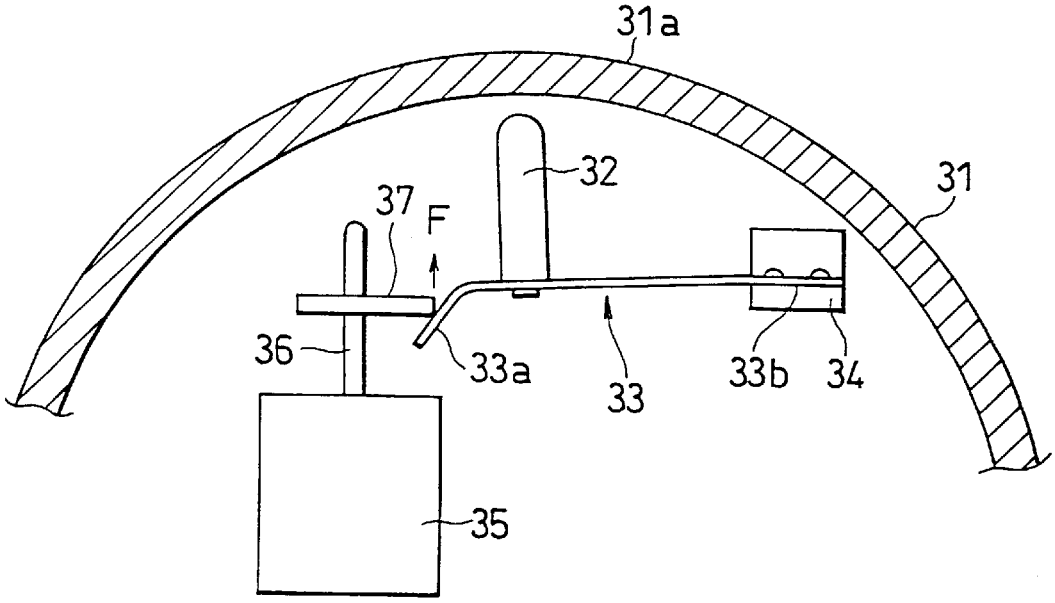
FIG. 8 PRIOR ART

Preferably, the supporting shafts A1, B1, the swingable shafts A2, B2 and the suspending arms A3, B3 are made from a metallic wire such as ordinary wires, copper wires and music wires having a circular cross section and having an elasticity, so that the frictional resistance decreases and the bending-formation processing becomes extremely easy. FIGS. 5(*a*) to 5(*d*) are a plan view, a front elevational view, a side elevational view and a perspective view, showing a spring A constructed by integrating the supporting shaft A1, the swingable shaft A2 and the suspending arm A3, whereas FIGS. 6(*a*) to 6(*d*) are a plan view, a front elevational view, a side elevational view and a perspective view, showing a spring B constructed by integrating the supporting shaft B1, the swingable shaft B2 and the suspending arm B3. Each of the bent portions is bent with a radius corresponding to an inner diameter of approximately 0.5 mm.

In FIGS. 1 and 3, numeral 5 represents a drive motor surrounded by a shroud 10 fixed to the base plate 9 and fixed with a screw 11. The drive motor 5 is equipped with electric wires 3, 3 connected to a pair of terminals 12, 12. Numeral 6 designates a drive shaft positioned at the rear side with respect to the pair of frames 4, 4 and disposed to be in parallel to the frames 4, 4. Numeral 13 depicts a crank disc fixed to a tip portion of the drive shaft 6, and character P signifies a crank pin protruding forwardly from the eccentric position of the crank disc 13, and in a way of being deeply involved at right angles in the above-mentioned bent loop portion B3L and of maintaining a proper clearance, the bent loop portion B3L is maintained to be in loosely engaging relation to the crank pin P in a state of being allowed to advance and retreat.

The base plate 9 is made of an engineering plastic such as a polyacetal resin and a polyamide resin. To stand against mold distortion, thermal deformation and others, reinforcing ribs 14, 14 or the like may be provided on the extensions of the frames 4, 4.

A body 2*a* of the hammer member 2 is made of a synthetic resin into a rectangular column-like configuration, and its tip portion accepts an inserted and fixed portion of a metal-made semi-spherical hitting member 2*b* therein. This hammer member 2 is held by the aforesaid swingable shafts A2, B2 loosely penetrating the body 2*a,* positioned between the pair of frames 4, 4 disposed in an opposed relation to each other, and is movable in parallel to the frames at substantially right angles with respect to the circumferential wall of the gong 1 in a state where a given separation is maintained therebetween.

Figure 2:
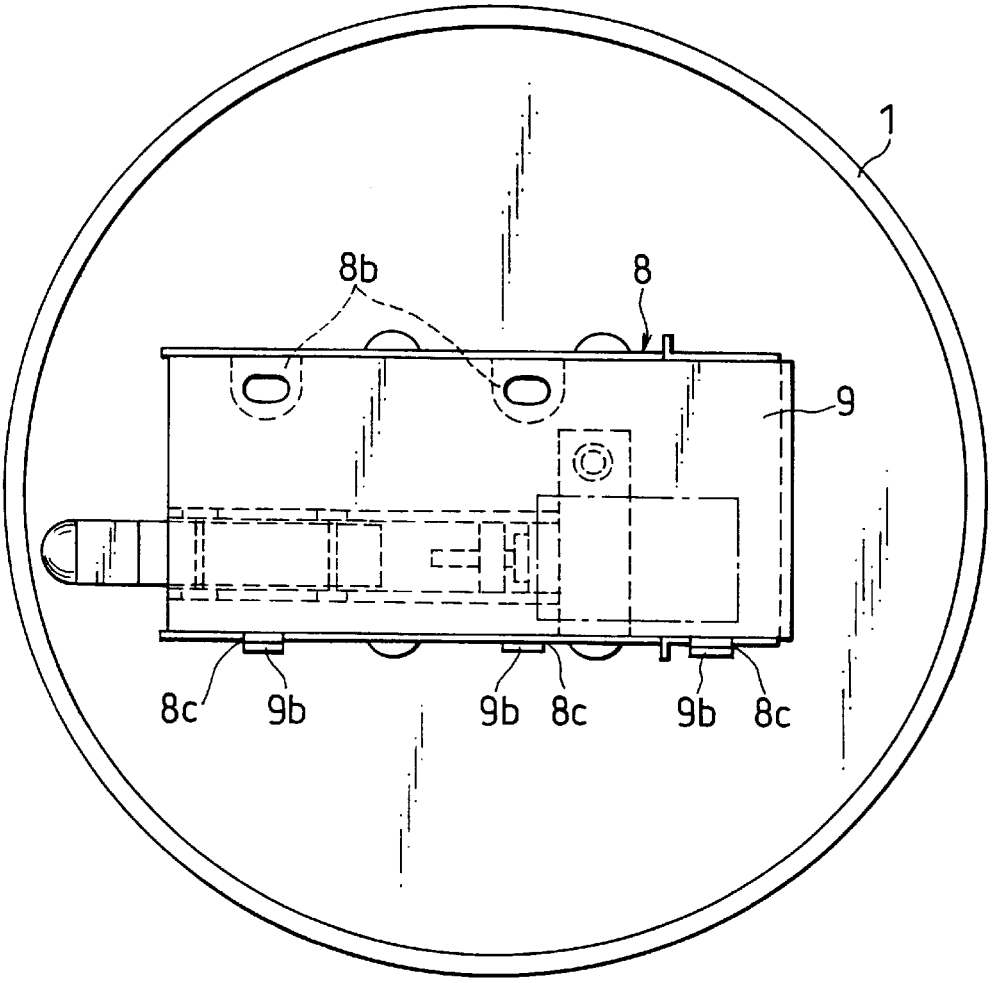
FIG. 2 is a rear elevational view showing the motor driven bell according to an embodiment of this invention.
Figure 4:
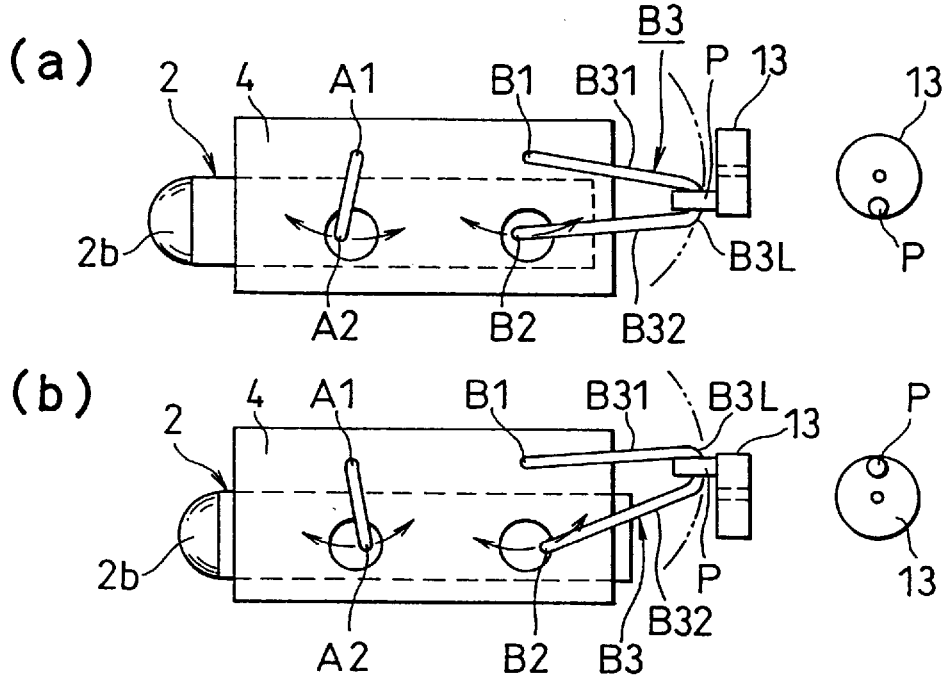
FIGS. 4(*a* and 4(*b*) are an illustration useful for describing an operating principle of the motor driven bell according to an embodiment of this invention.

Secondly, a description will be made hereinbelow of an operation thereof. On starting the drive motor 5, the crank disc 13 rotates through the drive shaft 6 so that the crank pin P takes a circular motion. As shown in FIG. 4(*b*), when the crank pin P reaches the highest position, the hammer member 2 stays at the retreated position (the right side in FIG. 4(*b*)). Subsequently, while the crank pin P rotates to arrive at the lowest position shown in FIG. 4(*a*), the bent loop portion B3L is pressed downwardly, and the suspending arm B3, together with the suspending arm A3, takes a pendulum motion about the supporting point B1, and at the same time, the swingable shafts B2, A2 move in the forward direction (the left side in FIG. 4(*a*)) to hit the gong 1. FIGS. 1 and 2 are illustrations of a state in which the hammer member 2 is at the neutral position. After hitting the gong 1, the hammer member 2 immediately retreats due to the reaction force, and in synchronism with this action, the crank pin P starts to rise, and therefore, the bent loop portion B31 is pressed upwardly while the suspending arm B3, together with the suspending arm A3, takes a pendulum action about the supporting point B1.

In this invention, the crank mechanism means a mechanism for converting the rotation of the drive motor shaft into the swinging movement of the swingable shaft 2.

As described above the amplitude of the pendulum motion and the speed of the drive motor can be set so that the retreating action of the hammer member 2 due to the reaction force after hitting the gong 1 synchronizes with the raising movement of the bent loop portion B3L to be taken when the crank pin P starts to rise, and even in case that a slight gap occurs therebetween, such a gap is absorbable not to produce an abnormal load toward the drive motor, since the bent loop portion B3L is in a loosely engaged relation to the crank pin P of the crank disc 13, and therefore power consumption can be minimized and a continuous excellent hammering sound can be produced.

Additionally, the aforesaid gap is also absorbable because of the elasticity of the spring B.

The motor driven bell according an aspect of this invention comprises a supporting shaft A1 born on a front side between a pair of frames disposed in an opposed relation to each other, a swingable shaft A2 suspended by a suspending arm A3 under the swingable shaft A2 to be swingable in the forward and backward directions, a supporting shaft B1 born at a rear portion between a pair of frames, a swingable shaft B2 suspended by a suspending arm B3 under the supporting shaft B1 to be swingable in the forward and backward directions, a hammer member held by the swingable shafts A2, B2 to be swingable in the forward and backward directions, a gong to be hit with the hammer member, a drive motor, and a link mechanism for converting the rotation of a shaft of the drive motor into a swinging motion of the swingable shaft B2, and therefore, like a suspended hammering bar mating with a hanging bell in a temple, the production of an excellent hammering sound is continuously possible, and further, since the rotation of the drive shaft is converted into the parallel movement of the hammer member suspended through the link mechanism, unlike the prior art in which the cam member necessarily comes into contact with the plate spring once per one revolution of the drive shaft and slides against the repulsion of the plate spring, the power consumption is remarkably reducible, owing to direct conversion of the rotaional energy of the drive motor into the parallel movement of the hammer member.

Moreover, in the motor driven bell according to another aspect of this invention, since the supporting shafts A1, B1, the swingable shafts A2, B2 and the suspending arms A3, B3 are constructed using a metallic wire rod processed by bending having a circular cross section, in addition to the above-mentioned effects, the number of parts used can be minimized, the bending processing can be made easily, and the cost price can be sharply reduced, and further, since the contact with the crank pin P is always made at a constant curved surface with no edge portion, the transmission force hardly varies, the abrasion of the contacting portion scarcely occurs, the coefficient of contact friction of the metallic wire rod is remarkably low, and the power consumption is more reducible.

In the motor driven bell according to a further aspect of this invention, the suspending arm B3 comprises an upper extending portion B31 extending backwardly with respect to the supporting shaft B1, a lower extending portion B32 extending backwardly with respect to the swingable shaft B2, and an intermediate bent loop portion B3L for making a connection between the upper and lower extending portions B31, B32, and the bent loop portion B3L is loosely engaged with a crank pin P fixedly secured to the drive shaft of the drive motor so that a vertical movement of the crank pin P is converted into a swinging movement of the bent loop portion B3L made in a state where the supporting shaft B1 of this bent loop portion B3L works as a supporting point, and therefore, in addition to the above-mentioned effects, even if the retreating motion of the hammer member 2 due to the reactive force after striking the gong 1 might not synchronize with the motion of the crank pin P coming up and pressing the bent loop portion B3L upwardly with a slight gap therebetween, since the bent loop portion B3L is loosely engaged with the crank pin P of the crank disc fixed to the drive shaft, the gap is absorbable without an abnormal load on the drive motor with minimized power consumption, and unlike the prior art, there is no problem of the plate spring and the cam member acting against each other to offset the striking force of the hammer member to the gong caused because the natural frequency of the plate spring does not coincide with the frequency of the plate spring forcibly moved by the cam member, and hence, an excellent hammering sound can be continuously produced.

It should be understood that the foregoing relates to only a preferred embodiment of the present invention, and that it is intended to cover all changes and modifications of the embodiment of the invention herein used for the purpose of the disclosure, which do not constitute departures from the spirit and scope of the invention.

What is claimed is:

1. A motor driven bell comprising:

a first supporting shaft born on a front side between a pair of frames disposed in an opposed relation to each other;

a first swingable shaft suspended by a first suspending arm under said first supporting shaft to be swingable in forward and backward directions;

a second supporting shaft born at a rear portion between said pair of frames;

a second swingable shaft suspended by a second suspending arm under said second supporting shaft to be swingable in the forward and backward directions;

a hammer member held by said swingable shafts to be swingable in the forward and backward directions;

a gong to be hit with said hammer member;

a drive motor; and a crank mechanism for converting rotation of a drive shaft of said drive motor into a swinging motion of said second swingable shaft.

2. A motor driven bell as defined in claim 1, wherein said supporting shafts said swingable shafts and said suspending arms are constructed using a metallic wire rod processed by bending and having a circular cross section.

3. A motor driven bell as defined in claim 1, wherein said second suspending arm comprises an upper extending portion extending backwardly with respect to said second supporting shaft, a lower extending portion extending backwardly with respect to said second swingable shaft, and an intermediate bent loop portion for making a connection between said upper and lower extending portions, said bent loop portion being loosely engaged with a crank pin fixedly secured to said drive shaft of said drive motor so that a vertical movement of said crank pin is converted into a swinging movement of said bent loop portion made in a state where said second supporting shaft of said bent loop portion works as a supporting point.

4. A motor driven bell as defined in claim 2, wherein said second suspending arm comprises an upper extending portion extending backwardly with respect to said second supporting shaft, a lower extending portion extending backwardly with respect to said second swingable shaft, and an intermediate bent loop portion for making a connection between said upper and lower extending portions, said bent loop portion being loosely engaged with a crank pin fixedly secured to said drive shaft of said drive motor so that a vertical movement of said crank pin is converted into a swinging movement of said bent loop portion made in a state where said second supporting shaft of said bent loop portion works as a supporting point.

* * * * *